US005133616A

United States Patent [19]

Oyaide et al.

[11] Patent Number: 5,133,616

[45] Date of Patent: Jul. 28, 1992

[54] PRINTING MACHINE

[75] Inventors: Shinichi Oyaide, Shizuoka; Masayoshi Kawahira, Mishima, both of Japan

[73] Assignee: Tokyo Electric Co., Ltd., Tokyo, Japan

[21] Appl. No.: 780,523

[22] Filed: Oct. 17, 1991

Related U.S. Application Data

[63] Continuation-in-part of Ser. No. 471,838, Jan. 29, 1990, abandoned.

[30] Foreign Application Priority Data

Feb. 2, 1989 [JP] Japan ..... 1-24398
May 16, 1989 [JP] Japan ..... 1-56013[U]

[51] Int. Cl.[5] ..... B41J 13/08

[52] U.S. Cl. ..... 400/635; 400/23; 400/634

[58] Field of Search ..... 400/635, 23, 29, 611, 400/634, 656, 636; 198/844.1, 845, 846, 847

[56] References Cited

U.S. PATENT DOCUMENTS 3,366,042 1/1968 Birch ..... 101/27
4,650,350 3/1987 Dorner ..... 400/120
4,743,129 5/1988 Keryhuel ..... 400/583.3
4,818,126 4/1989 Brooks et al. .
4,821,049 4/1989 Eckl ..... 400/635
4,867,058 9/1989 Luckhurst ..... 400/124
4,898,489 2/1990 Matsumoto et al. ..... 400/120

FOREIGN PATENT DOCUMENTS 0147340 8/1985 Japan ..... 400/635
0116883 5/1988 Japan ..... 400/635
63-254078 10/1988 Japan .

*Primary Examiner*—Edgar S. Burr
*Assistant Examiner*—John S. Hilten
*Attorney, Agent, or Firm*—Frishauf, Holtz, Goodman & Woodward

[57] ABSTRACT

A printing machine comprises a frame for supporting a pair of roller shafts spaced apart at a predetermined distance from each other and, a flat platen disposed between the roller shafts. An endless sheet-feeding belt made of an elastic material is stretched between the roller shafts. The sheet-feeding belt has an inner surface sliding on the flat platen by rotation of the roller shafts and an outer surface having such a high frictional coefficient that allows a sheet on the outer surface to be fed together with the sheet-feeding belt. A pair of pinch rollers hold the sheet in cooperation with the outer surface of the sheet-feeding belt at the roller shafts, for feeding the sheet. A printing head is opposed to the outer surface of the sheet-feeding belt at the flat platen.

12 Claims, 3 Drawing Sheets

PRINTING MACHINE

This application is a continuation-in-part, of application Ser. No. 07/471,838, filed Jan. 29, 1990, now abandoned.

BACKGROUND OF THE INVENTION

1. Field of the Invention

This invention relates to a printing machine which prints sheets from a normal size of B5 and the like to a small size of such as a post card and a visiting card, and more particularly to a printing machine provided with a flat platen.

2. Description of the Related Art

A conventional printing machine as shown in FIG. 1 comprises a printing head 2, a flat platen 3 facing the printing head 2, a pair of roller shafts 11 arranged at the front and rear sides of the flat platen 3 for passing the sheets in the space between the printing head 2 and the flat platen 3, pinch rollers 12 pressed against the corresponding roller shafts 11, a driving motor 13 for rotating the rear roller shaft 11 through a gear train 15, and sheet guides 14*a* and 14*b* and the like. A timing belt 16 is stretched between the roller shafts 11 so as to rotate the roller shafts 11 in the same direction at the same rotational speed.

Upon feeding various kinds of sheets in the direction X as shown in FIG. 1, this conventional printing machine is encountered with the following problems:

First, it is necessary to properly adjust the pressures exerted on the roller shafts 11 by the pinch rollers 12 in accordance with the thickness of the sheets. However, it is difficult to make an appropriate pressure adjustment which is suited for the sheets having different thicknesses. An insufficient pressure causes the roller shaft 11 to slip on the sheet 9, and an excessive pressure does not permit a thick sheet 9 to be inserted between the pinch roller 12 and the shaft roller 11, whereby the sheets 9 cannot be fed accurately in both cases.

Secondly, the provision of a damping rubber 4 on the printing face 3*a* of the flat platen 3 avoids the damage of the printing head 2 and lowers noise upon printing. Since, however, the printing heads 2 hits the same portion of the damping rubber 4 many times, the damping rubber 4 is worn out in a very short time.

The specification of the Japanese laid-open patent application No. 63-254078 discloses a printing machine in which a platen rubber is wound around driving rollers. It is convenient for this printing machine to feed a continuous sheet because the continuous sheet is fed by means of a sheet-feeding tractor, but this printing machine cannot accurately feed the sheets having different sizes ranging from the normal size of such as the B5 to the small size such as a post card.

SUMMARY OF THE INVENTION

The object of this invention is to provide a printing machine which easily feeds various sizes of sheets at a high accuracy and caries out a high accurate printing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
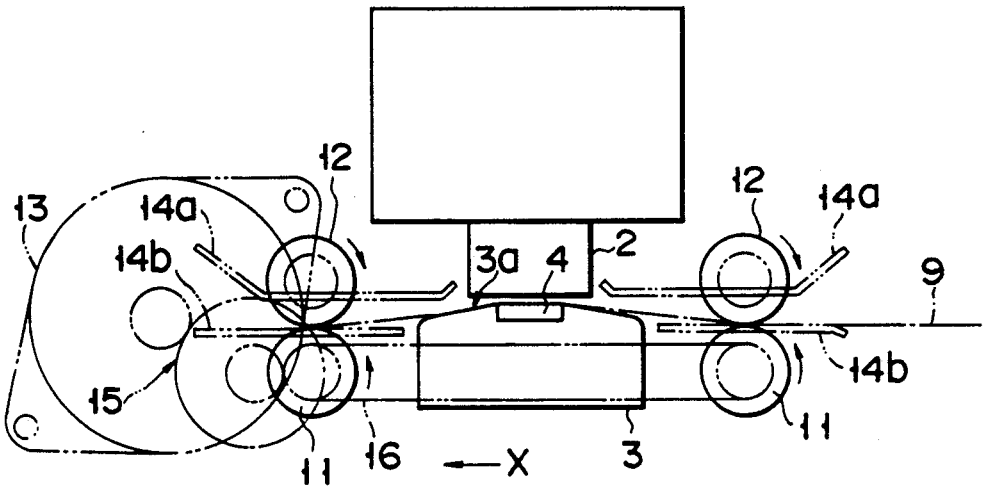
F I G. 1 (PRIOR ART)
FIG. 1 shows a structure of a conventional printing machine.

The structure of a printing machine according to this invention will be explained with reference to FIGS. 2 through 5.

A flat platen device 10 has a flat platen 3 extending in the direction perpendicular to the sheet feeding direction. The printing face 3*a* of the flat platen 3 has an arcuated form projecting towards a printing head 2 beyond the common tangent to the later described roller shafts 11. Both ends of the flat platen 3 are supported on the central portions of corresponding fixing plates 31 which are detachably connected to the frame 1 of an apparatus body. A pair of roller shafts 11 are rotatably mounted on both sides of the fixing plates 31 via bearings 41 so as to be disposed on both lateral sides of the flat platen 3.

Between the roller shafts 11 is stretched an endless sheet-feeding belt 21 which has an inner surface 21*b* sliding on the printing face 3*a* of the flat platen 3 and an outer surface 21*a* loading and transporting various sheets thereon and which surrounds the flat platen 3.

A gear train 15 driven by a driving motor 13 engages one of the roller shafts 11 of the flat platen device 10. As the driving motor 13 is driven, said one of the roller shafts 11 and the sheet-feeding belt 21 are rotated whereby the other roller shaft 11 is also rotated.

Pinch rollers 12 are supported on the apparatus body by means of supporting means (not shown) such that the pinch rollers 12 and the roller shafts 11 cooperate to pinch the sheet-feeding belt 21. The pinch rollers 12 are pressed against the roller shafts 11 at a constant pressure by means of urging means (not shown). Various sheets are inserted between the right pinch roller 12 and the right roller shaft 11 in FIG. 2 (more correctly, between the right pinch roller 12 and the sheet-feeding belt 21). Further, the printing head 2 and sheet guides 14*a* are supported on the apparatus body so as to be opposed to the flat platen device 10.

Preferably, the sheet-feeding belt 21 is made of an elastic material such as rubber so that the sheet 9 inserted between the pinch roller 12 and the roller shaft 11 (the sheet-feeding belt 21) makes a frictional engagement with the outer surface 21*a* of the sheet-feeding belt 21 and is elastically supported thereby. Particularly, it is preferred that the frictional coefficient of the outer surface 21*a* of the sheet-feeding belt 21 be set higher than that of the pinch rollers 12. The structure of the sheet-feeding belt 21 will be described in detail.

In general, when the temperature in the interior of the printing machine becomes high, the sheet-feeding belt 21 is liable to be stained with grease, such as MORUB-ALLOY (trade name) used at the bearing of the gear and LAUNA (trade name) used at the guide shaft of the printing head 2. Also, the sheet-feeding belt 21 may become stained with printing ink during the printing operation. If stained with such grease or print ink, the sheet-feeding belt 21 deteriorates in performance.

As the material of the sheet-feeding belt 21, it is thought to use one of the following: ethylene propylene terpolymer (EPT), urethane, styrene-butadiene rubber (SBR) and chloroprene rubber (CR).

With respect to these materials, the inventors of the present invention conducted a test, so as to examine their durability against the MORUB-ALLOY, LAUNA and printing ink. The test showed that the SBR, urethane and CR had satisfactory durability against the printing ink. The test also showed that only the SBR had satisfactory durability against the MORUB-ALLOY and LAUNA. Hence, it was considered that the SBR was most appropriate for use as the material of the sheet-feeding belt 21.

Further, the inventors of the present invention conducted a print test wherein sheet-feeding belts formed of SBR and having different thicknesses were prepared, and sheets were fed by use of these sheet-feeding belts. The test showed that sheets could be fed in a satisfactory manner when the sheet-feeding belts having a thickness in the range of 0.35 mm to 0.65 mm were employed. When sheet-feeding belts having a thickness smaller than 0.35 mm were employed, their durability was not very good. On the other hand, when sheet-feeding belts having a thickness larger than 0.65 mm were employed, their surfaces were roughened, with the result that the print condition was not very good. In conclusion, the overall results were good when the thickness of a sheet-feeding belt was in the range of 0.45 mm to 0.55 mm, and were best when the thickness was 0.5 mm.

Moreover, the inventors of the present invention conducted a hardness test, based on the "K6301" of the Japanese Industrial Standard. In the hardness test, sheet-feeding belts different in hardness were prepared and sheets were fed by use of these sheet-feeding belts. The test showed that sheets could be fed in a satisfactory manner when sheet-feeding belts having a hardness in the range of 97° A to 98° A were employed. When sheet-feeding belts having a hardness larger than 98° A were employed, they could not be tensed in a satisfactory manner. On the other hand, when the sheet-feeding belts having a hardness smaller than 97° A were employed, they were twisted or curved during printing, and sheets could not be fed in a satisfactory manner.

Figure 5:
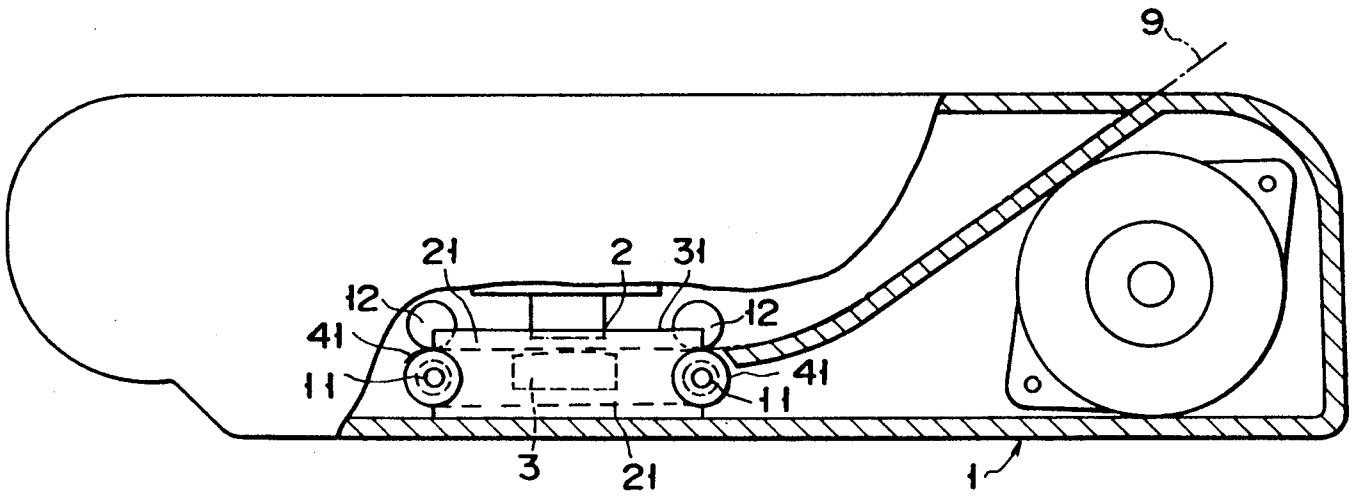
FIG. 5 is a partially broken front view of the printing machine of FIG. 2 mounted in an apparatus body.

The components of the flat platen device 10 are arranged in a predetermined positional relationship to form a unit structure and can be easily and quickly mounted on the frame 1 of the apparatus device (FIG. 5).

Figure 2:
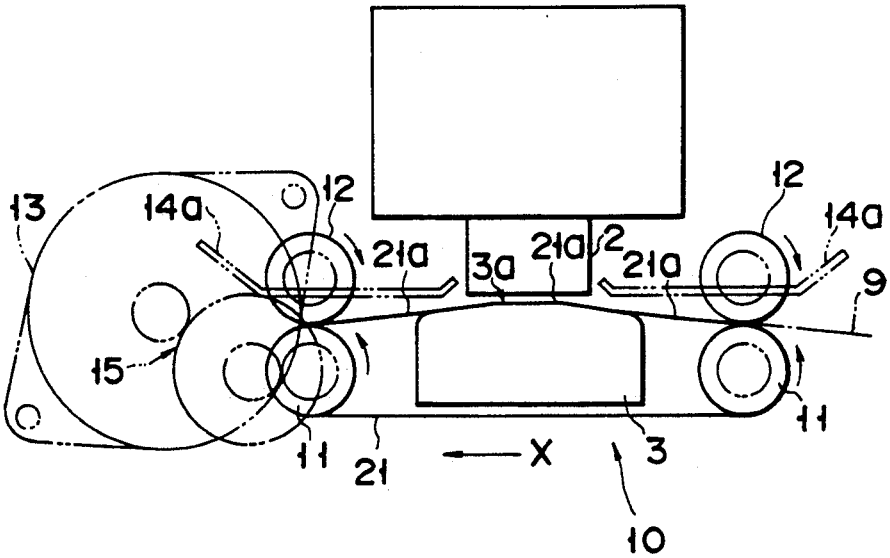
FIG. 2 shows a structure of one embodiment of this invention.
Figure 3:
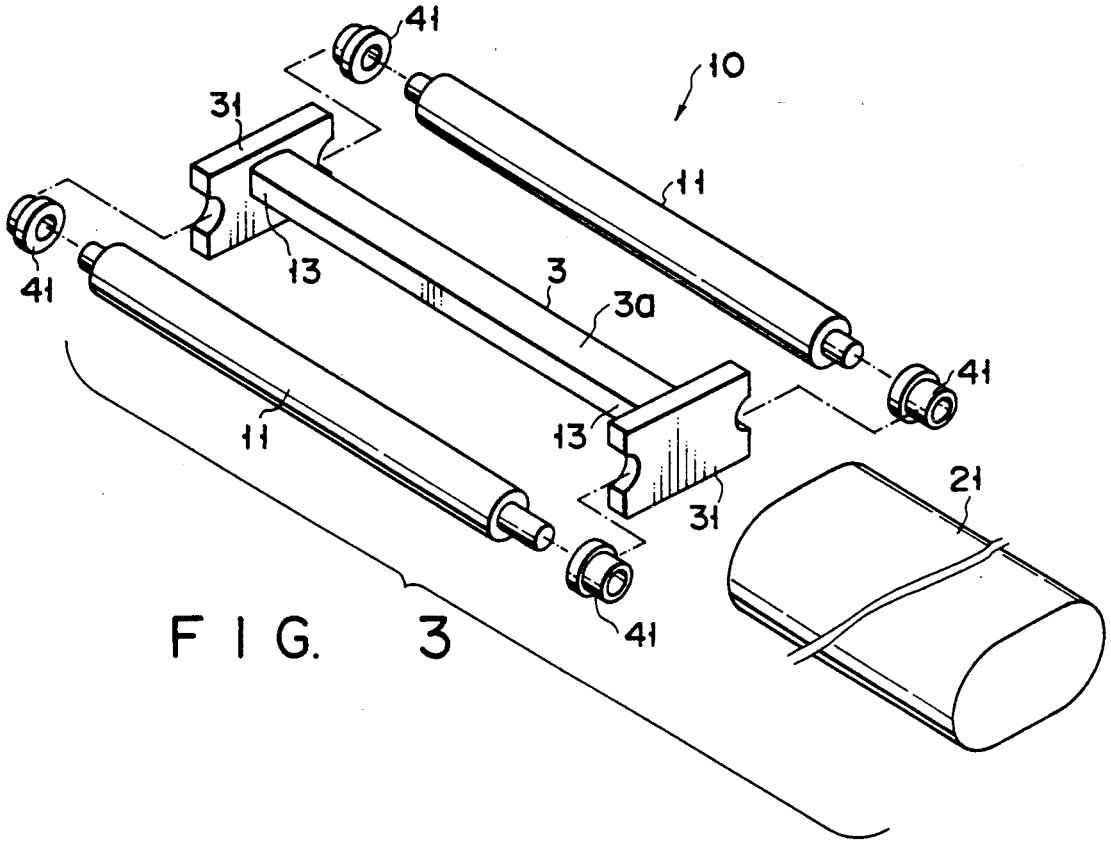
FIG. 3 is an exploded perspective view of a flat platen device used in the printing machine of FIG. 2.
Figure 4:
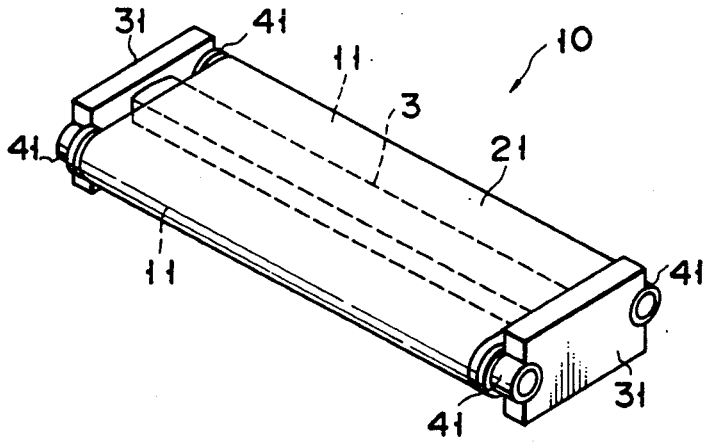
FIG. 4 is a perspective view of the assembled flat platen device of FIG. 3.

Referring now to FIG. 2, it will be explained how this printing machine prints various sizes of sheets. For easy understanding, the fixing plates 31 and the bearings 41 are omitted from FIG. 2.

The operation of the driving motor 13 rotates the roller shafts 11 and the pinch rollers 12 via the gear train 15 and the sheet-feeding belt 21 by predetermined revolutions in the direction shown by arrows. The sheet 9 inserted between the right roller shaft 11 and the right pinch roller 12 in FIG. 2 is pressed against the sheet-feeding belt 21 by the right pinch roller 12 and is fed by cooperation of the sheet-feeding belt 21 with the roller shafts 11 in the sheet-feeding direction X by a predetermined length corresponding to the above-mentioned revolutions of the roller shafts 11. In this state, the sheet 9 is elastically supported by the outer surface 21*a* of the sheet-feeding belt 21 (that is, assisted by the sheet-feeding belt 21) and is fed to the space between the printing head 2 and the flat platen 3. The sheet feeding is repeated by intermittently transporting the sheet at printing pitch intervals. At the same time, the head 2 is moved in the direction perpendicular to the sheet feeding direction X (that is, in the direction perpendicular to the sheet face of FIG. 2). During this operation, the head 2 strikes the sheet 9 on the printing face 3*a* of the flat platen 3 to effect printing.

As described above, the various sizes and various thicknesses of sheets 9 can be used in this printing machine. When thin sheets are printed, the pressure of the pinch rollers is insufficient. However, the thin sheets are elastically supported by the sheet-feeding belt 21 by frictional engagement therewith, whereby they are fed correctly to the space between the printing head 2 and the flat platen 3. Since the sheet-feeding belt 21 is always interposed between the sheet 9 and the flat platen 3, the sheet-feeding belt 21 acts as a damping rubber upon printing. Further, the head 2 hits the different portions of the sheet-feeding belt 21 so as to prevent the belt 21 from being worn out in a short time. This eliminates the disadvantages that the printing is hindered by the wearing out of the sheet-feeding belt in a short time. Still further, the arcuated projection of the printing face 3*a* of the flat platen 3 allows the sheet-feeding belt 21 to smoothly rotate without loosening it.

Additional advantages and modifications will readily occur to those skilled in the art. Therefore, the invention in its broader aspects is not limited to the specific details, representative devices, and illustrated examples shown and described. Accordingly, departures may be made from such details without departing from the spirit or scope of the general inventive concept as defined by the appended claims and their equivalents.

What is claimed is:

1. A printing machine comprising:

a frame;

a pair of roller shafts spaced apart at a predetermined distance from each other and rotatably supported on said frame;

a flat platen disposed between said roller shafts and having a printing face;

an endless sheet-feeding belt comprising a styrene-butadiene rubber material and provided around said roller shafts and stretched therebetween, said sheet-feeding belt having an inner surface sliding on said printing face of said flat platen by rotation of said roller shafts and an outer surface having such a high frictional coefficient that allows a sheet on said outer surface to be fed together with said sheet-feeding belt, said belt having a thickness in the range of 0.35 mm to 0.65 mm and a hardness in the range of 97° A to 98° A;

a pair of pinch rollers holding said sheet in cooperation with said outer surface of said sheet-feeding belt at said roller shafts, for feeding said sheet; and a printing head opposed to the outer surface of said sheet-feeding belt at said flat platen and movable to effect printing on said sheet on said outer surface of said sheet-feeding belt.

2. The printing machine according to claim 1, wherein said outer surface of said endless sheet-feeding belt has a frictional coefficient higher than that of the periphery surface of each of said pinch rollers.

3. The printing machine according to claim 1, wherein each of said flat platen and said roller shafts has both ends supported by a pair of fitting plates, and said fitting plates and said endless sheet-feeding belt constitute a unit detachably fixed to said frame.

4. The printing machine according to claim 1, wherein the thickness of said sheet-feeding belt is 0.50 mm.

5. The printing machine according to claim 1, wherein said printing face has a curved surface projecting towards said printing head.

6. The printing machine according to claim 5, wherein said printing face projects towards said printing head beyond a common tangent to said roller shafts.

7. A printing machine comprising:

a frame;

a pair of roller shafts spaced apart at a predetermined distance from each other and rotatably supported on said frame;

a flat platen disposed between said roller shafts and having a printing face;

an endless sheet-feeding belt comprising a styrene-butadiene rubber material and provided around said roller shafts and stretched therebetween, said sheet-feeding belt having an inner surface sliding on said printing face of said flat platen by rotation of said roller shafts and an outer surface which allows various kinds of sheets on said outer surface to be fed together with said feet-feeding belt, said belt having a thickness in the range of 0.35 mm to 0.65 mm and a hardness in the range of 97° A to 98° A;

a pair of pinch rollers holding one of said sheets in cooperation with said outer surface of said sheet-feeding belt at said roller shafts and having a frictional coefficient lower than that of said outer surface of said sheet-feeding belt, for feeding said one sheet; and a printing head opposed to the outer surface of said sheet-feeding belt at said flat platen and movable to effect printing on said one sheet on said outer surface of said sheet-feeding belt.

8. The printing machine according to claim 7, wherein each of said flat platen and said roller shafts has both ends supported by a pair of fitting plates, and said fitting plates and said endless sheet-feeding belt constitute a unit detachably fixed to said frame.

9. The printing machine according to claim 7, wherein said printing face has a curved surface projecting towards said printing head.

10. The printing machine according to claim 7, wherein the thickness of said sheet-feeding belt is in the range of 0.45 mm to 0.55 mm.

11. The printing machine according to claim 7, wherein the thickness of said sheet-feeding belt is 0.50 mm.

12. The printing machine according to claim 1, wherein the thickness of said sheet-feeding belt is in the range of 0.45 mm to 0.55 mm.

* * * * *